US012680226B2

(12) United States Patent
Cikman

(10) Patent No.: US 12,680,226 B2
(45) Date of Patent: Jul. 14, 2026

(54) ANTIBACTERIAL AND ANTIVIRAL FABRIC

(71) Applicant: Mustafa Cueneyt Cikman, Gebze (TR)

(72) Inventor: Mustafa Cueneyt Cikman, Gebze (TR)

( * ) Notice: Subject to any disclaimer, the term of this patent is extended or adjusted under 35 U.S.C. 154(b) by 845 days.

(21) Appl. No.: 17/995,868

(22) PCT Filed: Feb. 1, 2021

(86) PCT No.: PCT/TR2021/050095
§ 371 (c)(1),
(2) Date: Oct. 10, 2022

(87) PCT Pub. No.: WO2021/211075
PCT Pub. Date: Oct. 21, 2021

(65) Prior Publication Data

US 2023/0193555 A1 Jun. 22, 2023

(30) Foreign Application Priority Data

Feb. 1, 2021 (TR) ..... 2020/05867

(51) Int. Cl.
*D06M 11/82* (2006.01)

(52) U.S. Cl.
CPC ..... *D06M 11/82* (2013.01); *D10B 2401/13* (2013.01)

(58) Field of Classification Search
CPC ..... D06M 11/82; D10B 2401/13
USPC ..... 8/115.6
See application file for complete search history.

(56) References Cited

U.S. PATENT DOCUMENTS

| | | | | |
|---|---|---|---|---|
| 6,861,396 | B2 * | 3/2005 | Baker | C11D 3/225 510/276 |
| 7,648,534 | B2 * | 1/2010 | Li | C11D 3/0068 428/95 |
| 2010/0009359 | A1 | 1/2010 | Markowitz | |

FOREIGN PATENT DOCUMENTS

| | | | | |
|---|---|---|---|---|
| CN | 103114005 A | * | 5/2013 | |
| CN | 107675481 A | | 2/2018 | |
| JP | 2000256101 A | * | 9/2000 | A01N 25/06 |
| JP | 2002020207 A | * | 1/2002 | A01N 25/02 |

OTHER PUBLICATIONS

Iyigundogdu, Z. U., Demir, O., Asutay, A. B., & Sahin, F. (2017). Developing novel antimicrobial and antiviral textile products. Applied biochemistry and biotechnology, 1813), 1155-1166. Abstract, "Introduction"-last paragraph, "Preparation of Antimicrobial Textile Products".

Sokmen, N., & Buyukakinci, B. Y. (2018, September). The Usage Of Boron/Boron Compounds In The Textile Industry And Its Situation In Turkey. In CBU International Conference Proceedings (vol. 6, pp. 1158-1165). Abstract, Table 3.

Chiyomi, M., Momoe, U., Naoki, H., Tomovyoshi, Y., Hideaki, M., & Kanji, K. (2013). Study of Weak-acidic Clothing Materials Developed for Skin Conditioning. 69(A), 73-77. Abstract.

* cited by examiner

*Primary Examiner* — Amina S Khan
(74) *Attorney, Agent, or Firm* — Bayramoglu Law Offices LLC

(57) ABSTRACT

The present invention relates to a nontoxic antibacterial and antiviral fabric employed in the production of a variety of textiles used in a plurality of fields, particularly in the field of health.

3 Claims, No Drawings

ANTIBACTERIAL AND ANTIVIRAL FABRIC

TECHNICAL FIELD

The present invention relates to a nontoxic antibacterial and antiviral fabric developed for providing textiles used in a plurality of fields, particularly in the field of health, with antibacterial and antiviral properties.

PRIOR ART

In today's world, a variety of antibacterial products are used in areas requiring hygiene, particularly in the field of health, and sanitary textile products made of antibacterial fabrics are also included among such products.

In order to impart antibacterial properties to textiles, various antibacterial solutions are impregnated on the threads of the fabric constituting the textile. Such solutions impregnated on the threads usually contain silver ion, and as is known, silver ion is a substance belonging to the class of heavy metals, and causes a variety of toxic effects in both short and long periods as a result of its penetration into the body following a prolonged contact therewith. The use of solutions containing silver ion for imparting antibacterial properties to textiles results in a great variety of serious damages, as well as its benefits.

Of a several studies carried out on the said subject-matter, a national patent application no. TR 2018/08516 discloses "a novelty in a method for producing an environment-friendly antibacterial fabric", and states that the respective study relates to a method for producing an environment-friendly fabric used as an odor-resistant antibacterial fabric in the field of textile, and as antibacterial textile products such as bandage, surgical gown, etc. in the field of health.

Another national patent application no. TR 2018/00468 discloses "a method for producing an antibacterial fabric from the extract of the roots of *Althaea officinalis* L. (medicinal marshmallow)", and states that the respective study relates to a method comprising the steps of specifically processing the roots of *Althaea officinalis* L. (medicinal marshmallow) to extract the antibacterial components therein without allowing them to decompose, and of efficiently applying the resulting extract on fabrics again without allowing such antibacterial components to decompose in order to obtain an antibacterial fabric.

Thus, the need to eliminate such shortcomings and disadvantages of the embodiments and practices employed in the prior art entails an improvement in the respective technical field.

OBJECTIVE OF THE INVENTION

The present invention relates to an antibacterial and antiviral fabric developed for eliminating the aforementioned disadvantages and providing new advantages to the respective technical field.

The objective of the present invention is to provide for an antibacterial and antiviral fabric which can be employed for obtaining textiles used in a plurality of fields, especially in the field of health, features antibacterial and antiviral properties, and also, has no toxicity as it does not contain metals included in the class of heavy metals, such as silver or the like, unlike the already existing products of the same kind.

The structural and characteristic features of the present invention, including all of its advantages, will be more clearly understood when the detailed description given below is read, and thus, the present invention should be evaluated by taking this detailed description into consideration.

DETAILED DESCRIPTION OF THE INVENTION

The preferred alternatives of the present disclosure, which are mentioned in this detailed description, are only intended for providing a better understanding of the subject-matter, and therefore, should not be construed in any restrictive sense.

The present invention relates to a fabric developed for providing textiles used in a plurality of fields, particularly in the field of health, with antibacterial and antiviral properties. The said antibacterial and antiviral fabric of the present invention is impregnated with an antibacterial solution containing no metals belonging to the class of heavy metals, such as silver or the like, and thus, the toxic effects caused by heavy metals are avoided.

The solution impregnated on the threads of the antibacterial and antiviral fabric of the present disclosure contains, instead of heavy metals such as silver ion or the like, an acidity regulator for obtaining a more effective solution against microorganisms through an increase in the levels of $H_3BO_3$ (Boric acid) and acidity, and $C_6H_7KO_2$ (Potassium sorbate) is preferably used as an acidity regulator.

The amounts of $H_3BO_3$ (Boric acid) and $C_6H_7KO_2$ (Potassium sorbate) in the solution are the same, and the solution is prepared by mixing these ingredients with the same level of distilled water under room temperature. The solution thus prepared is impregnated on the threads of the fabric desired to be provided with antibacterial and antiviral properties.

By using $H_3BO_3$ (Boric acid) instead of silver ion, an antibacterial and antiviral fabric preventing the formation of microorganisms without showing any toxic effects which will adversely affect the human health is obtained, as well as the boron reserves, which have a strategic significance, are put to good use and transformed into a product with a high added value.

What is claimed is:

1. An antibacterial and antiviral fabric employable for obtaining a textile used in the field of heath, the fabric having antibacterial and antiviral properties, and no heavy metal-based toxicity as it does not contain metals classified as heavy metals, characterized in that the antibacterial and antiviral fabric consists of fabric threads and an antibacterial solution impregnated on the fabric threads, wherein the antibacterial solution consists of $H_3BO_3$ (Boric acid) for providing antibacterial and antiviral effects, $C_6H_7KO_2$ (Potassium sorbate) as an acidity regulator, and distilled water; wherein the amount of distilled water in the antibacterial solution is equal to the total amount of $H_3BO_3$ and $C_6H_7KO_2$.

2. An antibacterial and antiviral fabric according to the claim 1, characterized in that the acidity regulator provides an antibacterial property through an increase in the level of acidity.

3. A method for obtaining an antibacterial and antiviral fabric, characterized in that the method consists of:

mixing equal amounts of $H_3BO_3$ (Boric acid) and $C_6H_7KO_2$ (Potassium sorbate) with distilled water under room temperature to prepare a solution, wherein the amount of water is equal to the total amount of $H_3BO_3$ and $C_6H_7KO_2$, and impregnating only the antibacterial solution on fabric threads wherein the obtained antibacterial and antiviral fabric consists of the fabric threads and the antibacterial solution impregnated on the fabric threads.

* * * * *